US007637789B2

(12) United States Patent
Nakatani et al.

(10) Patent No.: US 7,637,789 B2
(45) Date of Patent: Dec. 29, 2009

(54) TERMINAL CONNECTION STRUCTURE HAVING ONE TERMINAL WITH OPPOSED CONVEX AND CONCAVE PORTIONS

(75) Inventors: Shinya Nakatani, Hitachinaka (JP); Shin Onose, Naka (JP); Yasunori Odakura, Mito (JP)

(73) Assignee: Hitachi, Ltd., Tokyo (JP)

( * ) Notice: Subject to any disclaimer, the term of this patent is extended or adjusted under 35 U.S.C. 154(b) by 112 days.

(21) Appl. No.: 11/938,341

(22) Filed: Nov. 12, 2007

(65) Prior Publication Data

US 2008/0113526 A1 May 15, 2008

(30) Foreign Application Priority Data

Nov. 15, 2006 (JP) ..... 2006-308544

(51) Int. Cl.
*H01R 4/02* (2006.01)

(52) U.S. Cl. ..... 439/874; 439/76.2

(58) Field of Classification Search ..... 439/874, 439/76.2, 55, 59, 65–66, 74; 174/72 B; 361/624
See application file for complete search history.

(56) References Cited

U.S. PATENT DOCUMENTS 4,818,823 A * 4/1989 Bradley ..... 174/259
5,932,891 A * 8/1999 Higashi et al. ..... 257/48
6,210,173 B1 * 4/2001 Matsunaga ..... 439/66
6,666,690 B2 * 12/2003 Ishizuka et al. ..... 439/66
6,843,658 B2 * 1/2005 Kuwabara et al. ..... 439/66
7,097,470 B2 * 8/2006 Harper, Jr. ..... 439/83
7,335,068 B2 * 2/2008 Dwan et al. ..... 439/700
7,419,378 B2 * 9/2008 Ha et al. ..... 439/39

FOREIGN PATENT DOCUMENTS

JP 10-64951 A 3/1998

* cited by examiner

*Primary Examiner*—Michael C Zarroli
(74) *Attorney, Agent, or Firm*—Crowell & Moring LLP

(57) ABSTRACT

A convex portion which inclines in the direction of the short side is created by press work along the direction of the short side of a terminal, which extends longitudinally, from one end to the other end, and another terminal is pressed onto the convex portion with pressure and bonded together by electric resistance welding. At this time, because the convex portion inclines in the direction of the short side, the convex portion is not deformed and crushed; consequently, it is possible to ensure the area of the contact at which terminals are bonded together.

12 Claims, 3 Drawing Sheets

TERMINAL CONNECTION STRUCTURE HAVING ONE TERMINAL WITH OPPOSED CONVEX AND CONCAVE PORTIONS

CLAIM OF PRIORITY

The present application claims priority from Japanese application serial No. 2006-308544, filed on Nov. 15, 2006, the content of which is hereby incorporated by reference into this application.

FIELD OF THE INVENTION

The present invention relates to a connection structure of terminals, a method of connecting terminals, and a control device.

BACKGROUND OF THE INVENTION

Conventionally, in order to connect terminals which extend longitudinally, those terminals are superposed, pressurized and bonded together in the direction the terminals come in contact with each other, thereby making a connection. In this manner, to make terminals securely come in contact with each other, a strong pressing force must be applied.

Accordingly, as shown in Japanese Patent Laid-open No. Hei 10(1998)-64951, a technology has been presented wherein a hemispherically-shaped convex portion or a convex portion formed along the direction of the short side of the terminal is created on one elongated terminal, thereby securely bonding terminals.

SUMMARY OF THE INVENTION

However, in order to create a hemispherical convex portion on a terminal, the length of the terminal in the direction of its short side must be long. For this reason, there are problems in that those terminals cannot be applied to small devices including control devices.

Furthermore, it is easy to create a convex portion formed along the direction of the short side of a terminal even if the length of the terminal in the direction of its short side is short. However, there are problems in that when a terminal is pressed onto the other terminal, the convex portion will be deformed in the direction the convex portion will be crushed.

It is an object of the present invention to provide a connection structure of terminals, a method of connecting terminals, and a control device which can be applied to small devices and also enable terminals to be bonded together securely.

In a connection structure of terminals according to the present invention, a convex portion and a concave portion both of which are longer than the length of a first terminal in the direction of its short side are created on the first terminal which extends longitudinally, and a second terminal is connected to the first terminal at the convex portion.

In a method of connecting terminals according to the present invention, a substantially linear convex portion, which includes at least a portion that intersects with the direction of the short side of the first terminal extending longitudinally, is created by press work, and a second terminal is bonded with pressure to the convex portion.

A control device according to the present invention is made up of an elongated metal plate on which a convex portion is created on a bus bar from its one end to the other end in the direction of its short side, wherein the convex portion has a portion that does not extend in the direction of the short side of the bus bar, and a lead is connected to the convex portion.

According to the present invention, it is possible to securely and reliably bond terminals together.

DESCRIPTION OF THE PREFERRED EMBODIMENTS

Hereafter, embodiments of the present invention will be described with reference to the drawings.

First Embodiment

Figure 1:
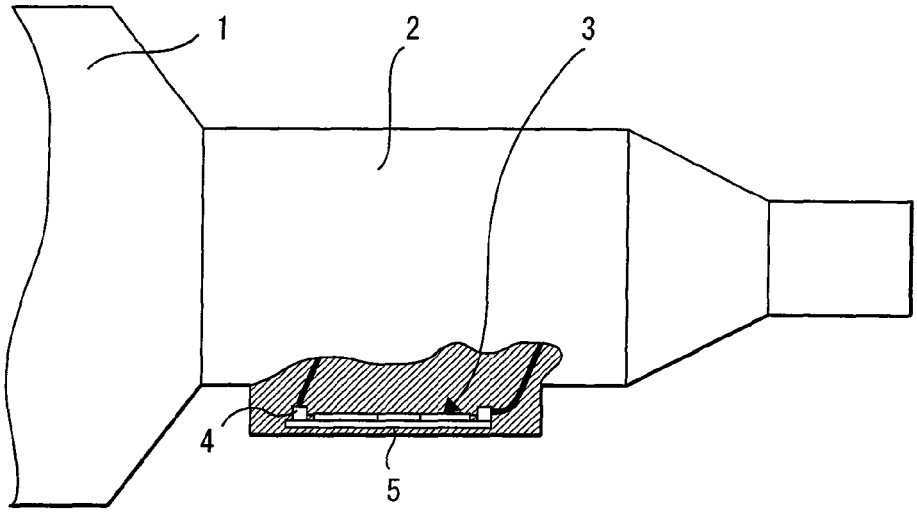
FIG. 1 shows a partial cross-section of a control device included in a housing of a transmission according to an embodiment of the present invention.
Figure 2:
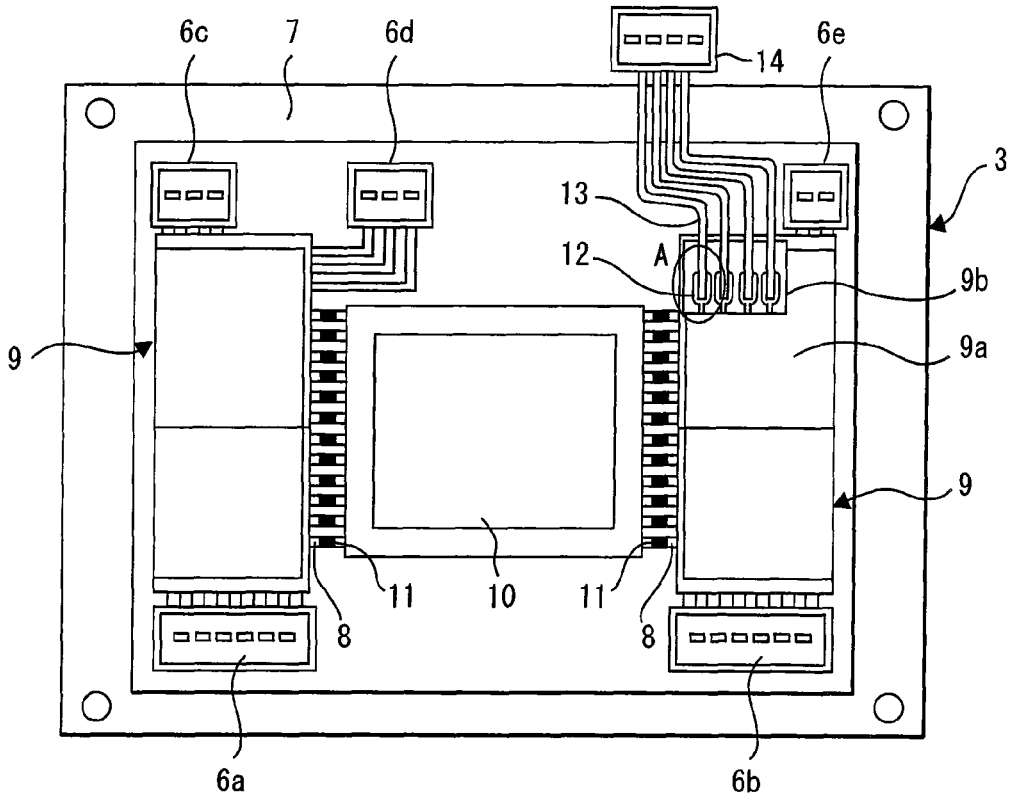
FIG. 2 is a top view of a hydraulic control device of a transmission.
Figure 3:
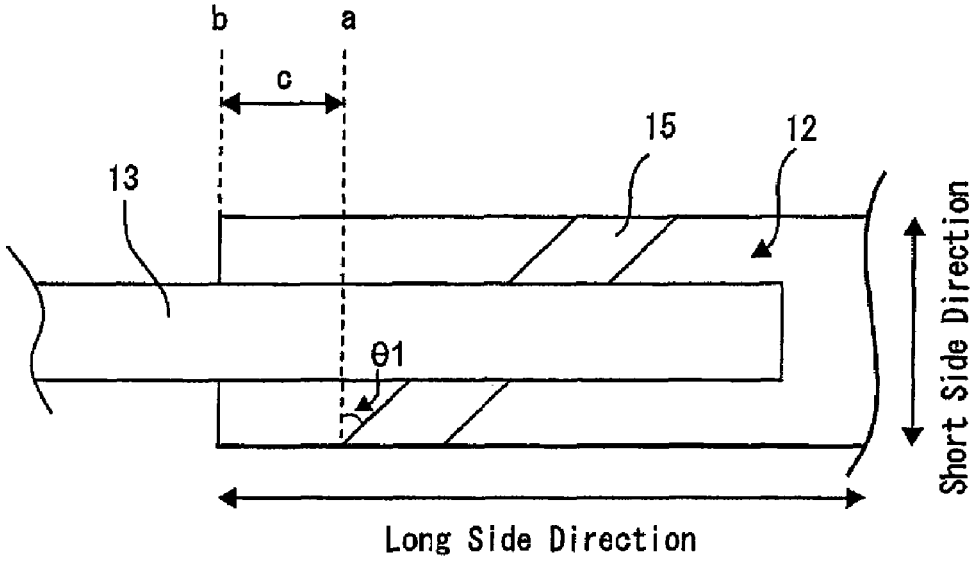
FIG. 3 is a top view of a first terminal and a second terminal bonded together in a first embodiment.
Figure 4:
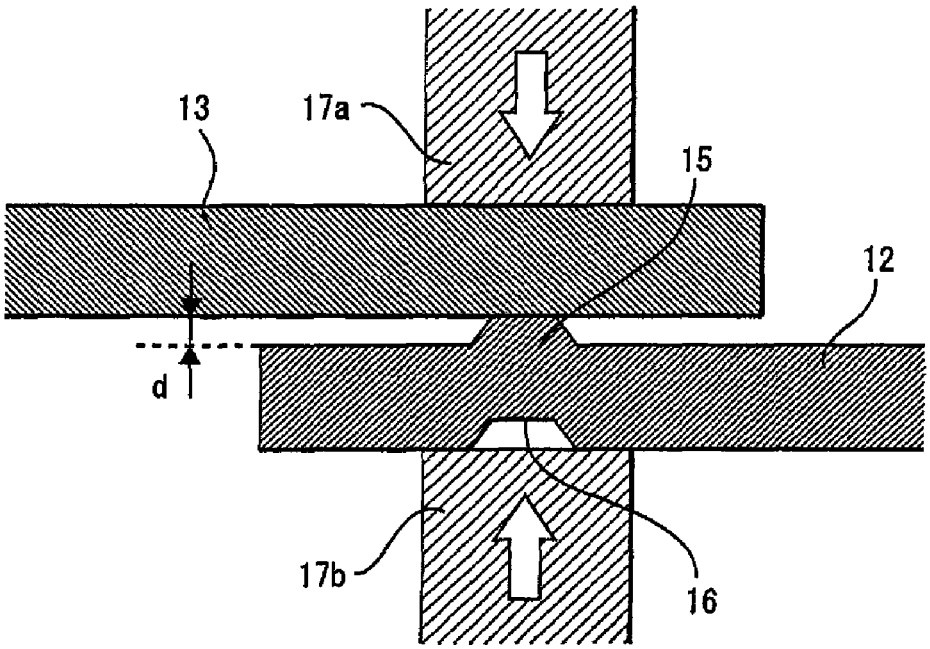
FIG. 4 is a cross sectional side view showing the condition in which a first terminal and a second terminal are bonded together by electric resistance welding.

FIG. 1 shows a partial cross section of a control device included in a housing of an automobile's automatic transmission according to an embodiment of the present invention. FIG. 2 is a top view of a hydraulic control device of an automatic transmission. FIG. 3 is a top view of a first terminal and a second terminal bonded together in a first embodiment. FIG. 4 is a cross sectional side view showing the condition in which a first terminal and a second terminal are bonded together by electric resistance welding.

In FIG. 1, a transmission 2 is connected to an automobile's engine 1 so that torque is transmitted from the engine 1 to the transmission 2. At the bottom of the inside of the transmission 2, a hydraulic control device 3 is disposed to function as a control device; and the hydraulic control device 3 is used for hydraulically controlling the work of the clutch provided inside the transmission. Furthermore, on the hydraulic control device 3, there are immobilizedly provided a solenoid valve 4 for controlling hydraulic pressure and a control module 5 on which electronic components such as CPU for creating control signals are molded with resin. The solenoid valve 4 is connected to connectors 6*c*, 6*d*, 6*e* of the control module 5 shown in FIG. 2.

Next, the detail of the hydraulic control device 3 will be described with reference to FIG. 2. The hydraulic control device 3 includes a rectangular base 7 made of metal (SPCC) immobilized in the housing of the transmission, and a plurality of bus bars 8 made of metal (copper alloy such as phosphor bronze) extend inwardly, facing one another, from both ends of the base 7 in the direction of the long side of the base 7. Furthermore, the edge portion of the bus bars 8 are inserted and molded with resin thereby creating an insulating mold 9 so as to prevent a short-circuit from occurring between connectors. The insulating mold 9 is divided into four blocks: two on both sides. Moreover, an insulating mold 9*a* located at the upper right in FIG. 2 has a substantially rectangular through-hole 9*b* created on one end of the base 7 in the direction of its long side and close to the control module 5.

On one end of the insulating mold 9 facing the long side of the base 7, connectors 6*a*, 6*b* to be connected to an automobile's harnesses are disposed; and on the other end of the insulating mold 9 facing the long side of the base 7, connectors 6*c*, 6*d*, 6*e* to be connected to the solenoid valves 4 are disposed.

Furthermore, between bus bars 8 disposed on both ends of the base 7 in the direction of the long side, a control module 10 on which electronic components such as CPU for creating control signals are molded with resin is disposed. On both sides of the control module 10, terminals 11 made of metal (pure copper) the quantity of which is the same as that of bus bars 8 are created so that those terminals protrude. Each of those terminals 11 is bonded to each of the bus bars 8 by laser welding.

Furthermore, in the through-hole 9*b* of the insulating mold 9*a*, a plurality of (four) bus bars 12 connected to the control module protrude toward one end of the insulating mold 9*a* in the direction of its long side; and those bus bars 12 are located in a row in the direction substantially orthogonal to the direction along which bus bars 8 are disposed. The bus bar 12, which is an elongated plate made of metal (copper alloy such as phosphor bronze) and extends longitudinally, is substantially rectangular; however, the width of the tip area of the bus bar 12 in the direction of its short side is wider to create a connection, and the width of the root area of the bus bar 12 is smaller than that of the tip area. Moreover, the bus bar 12 constitutes a first terminal.

Each of connector leads 13 which functions as a lead that constitutes a second terminal is connected to each of the bus bars 12; and the connector leads 13 are flexibly deformable so as to allow the connector 14 to be connected to an external terminal located in a variety of locations. For this reason, the location of an automobile's connector that functions as an external terminal to which the connector 14 is connected is not limited, thereby complying with any types of cars. Moreover, the connector lead 13 is a round wire, made of metal (pure copper), which is entirely coated with insulating material and has a circular cross section; however, the insulating coating of the connection portion to connect the bus bar 12 is removed.

Next, the detail of the connection structure between the bus bar 12 functioning as a first terminal and the connector lead 13 functioning as a second terminal will be described with reference to FIGS. 3 and 4. FIG. 3 shows the wide tip area of a bus bar 12 and the connection portion between the bus bar 12 and the connector lead 13.

Although the length of the bus bar 12 in the direction of its short side is approximately 2 mm, it is preferable that the length be between 0.5 mm and 3 mm so as to easily connect the bus bar 12 to the connector lead 13 and reduce the size of the control device. Furthermore, although the thickness of the bus bar 12 is approximately 0.64 mm, it is preferable that the thickness be between 0.2 mm and 1.2 mm in the light of the strength of the connection with the connector lead 13. Furthermore, although the length of the wide portion of the bus bar 12 in the direction of the long side of the bus bar 12 is approximately 4 mm, it is preferable that the length be between 3 mm and 5 mm so as to easily connect the bus bar 12 to the connector lead 13 and reduce the size of the control device.

The bus bar 12 has a convex portion 15 created by press work along the short side of the bus bar 12 from one end to the other end, and on the opposite side of the convex portion 15, a concave portion 16 is created which corresponds to the convex portion 15. The convex portion 15 is substantially straight and made oblique with an angle to both the direction of the short side and the direction of the long side of the bus bar 12 and intersects with the direction of the short side of the bus bar 12. That is, both the convex portion 15 and the concave portion 16 are longer than the length of the bus bar 12 in the direction of the short side of the bus bar 12. Furthermore, the length [c] from the tip [a] of the convex portion 15 in the direction of the long side of the bus bar 12 to the tip [b] of the bus bar 12 in the direction of its long side is greater than the height [d] of the convex portion.

Furthermore, as shown in FIG. 4, the convex portion 15 is substantially trapezoidal: the width of the cross section becomes smaller toward the top surface. Therefore, a substantially straight flat plane is created on the top surface along the direction in which the convex portion 15 extends. Since the convex portion 15 is created by press work as mentioned above, the cross section of the concave portion 16 is also substantially trapezoidal in the same manner as the convex portion 15.

Next, a method of bonding a connector lead 13 to a bus bar 12 will be described hereafter. Electric resistance welding is used to bond together the connector lead 13 and the bus bar 12.

First of all, bus bars 12 are embedded in an insulating mold 9*a* by means of injection molding with resin so that only the connection portion of the bus bars protrudes from the through-hole 9*b*. Next, a connector lead 13 is disposed on the top surface of the convex portion 15 along the direction of the long side of the bus bar 12 and at a substantially middle position in the direction of the short side of the bus bar 12. At this time, the insulating mold 9*a* has not been mounted onto the base 7. In this condition, as shown in FIG. 4, electrodes 17*a*, 17*b* are made contacted from the connector lead 13 side and the concave portion 16 side, then pressurized, and electrified. Consequently, resistance heat causes the bus bar 12 and the connector lead 13 to melt and be bonded together.

Herein, as shown in patent document 1 mentioned above, in the case in which a convex portion and a concave portion are created on a bus bar along the direction of its short side, when electrodes are made contacted with pressure, stress concentrates on the tip of the convex portion, thereby causing the bus bar to be deformed resulting in crushing the convex portion. At this time, because the tip area of the bus bar extending from the convex portion is a free end, when the convex portion is crushed, the tip of the bus bar is simultaneously lifted toward the connector lead in some cases. Herein, because the length between the convex portion to the tip of the bus bar in the direction of the long side of the bus bar 12 is greater than the height of the convex portion, the lifted tip of the bus bar comes in contact with the connector lead. For this reason, there are problems in that the area of a contact of the convex portion at which the convex portion comes in contact with a connector lead decreases and electric current splits from the bus bar's tip, other than the convex portion, at which the bus bar has come in contact with the connector lead, thereby inhibiting secure welding. Furthermore, there are problems in that not only while the bus bar is pressurized, but also while the bus bar is pressurized, electrified, and welded, the portion around the top surface of the convex portion becomes softened due to heat, resulting in deformation. One of those factors is a decrease in rigidity of the terminal because the backside of the convex portion is concave.

On the contrary, in this embodiment, the convex portion 15 is not created along the direction of the short side of the bus bar 12, but is made oblique with an angle to the direction of the short side; therefore, the length of the entire convex portion 15 becomes greater, increasing the rigidity of the convex portion 15. Consequently, the convex portion 15 is not deformed when it is pressurized by means of electrodes. Furthermore, even if a bus bar 12 is softened due to heat generated during the welding process, deformation does not easily occur. As a result, it is possible to execute secure and reliable welding.

As stated above, the detail of the first embodiment was described. Hereafter, the effects of the first embodiment will be described.

A first embodiment is a connection structure of terminals in which a second terminal is connected to a first terminal which extends longitudinally. On the first terminal, a convex portion is created along the short side of the first terminal from one end to the other end, and a concave portion which corresponds to the convex portion is created on the opposite side of the convex portion. Both the convex portion and the concave portion are longer than the length of the first terminal in the direction of its short side, and the second terminal is connected at the convex portion. Therefore, even if the second terminal is connected to the first terminal while the second terminal is strongly pressed onto the first terminal, the convex portion is not deformed. For this reason, the area of the contact at which the first terminal comes in contact with the second terminal does not decrease, and a constant surface pressure can be ensured when the second terminal is strongly pressed onto the first terminal; therefore, secure and reliable connection can be ensured. Specifically, when the convex portion is welded to the second terminal, it is possible to securely weld together the first terminal and the second terminal while those terminals are securely coming contact with each other, thereby stabilizing the bonding condition.

Moreover, in order to make the convex portion and the concave portion longer than the length of the first terminal in direction of the short side of the first terminal, it is considered that a portion is provided which has an angle $\theta_1$ to the direction of the short side of the first terminal. Specifically, by making the convex portion and the concave portion substantially straight, it is easy to create a convex portion even on a very small terminal, made of copper alloy, with a thickness between 0.4 mm and 0.8 mm and a length between 3 mm and 5 mm in the direction of the short side.

Furthermore, in the case of a first embodiment, since the second terminal is a wire, it must be bonded with pressure when bonded to the first terminal. Specifically, when the second terminal is bonded substantially along the direction of the long side of the first terminal, the second terminal easily comes in contact with the convex portion. In the first embodiment, because the convex portion is made substantially straight having an angle to the direction of the short side of the first terminal, it is possible to increase the area of the contact at which the convex portion comes in contact with the second terminal. Furthermore, by bonding the second terminal to the first terminal at a substantially middle position in the direction of the short side of the first terminal, it is possible to prevent the second terminal from being removed from the convex portion when pressure is applied.

Furthermore, a first embodiment is a method of connecting terminals in which a second terminal is connected to a plate-like first terminal which extends longitudinally. On a metal plate which extends longitudinally, a substantially linear convex portion which at least includes a portion that intersects with the direction of the short side of the metal plate is molded by press work, and a second terminal is bonded to the molded convex portion with pressure, thereby connecting the first terminal to the second terminal. Therefore, the convex portion is not deformed when the second terminal is strongly pressed onto the first terminal. For this reason, the area of the contact at which the first terminal comes in contact with the second terminal does not decrease, and a constant surface pressure can be ensured when the second terminal is strongly pressed onto the first terminal; therefore, secure and reliable connection can be ensured. Specifically, when the convex portion is welded to the second terminal, it is possible to securely weld together the first terminal and the second terminal while those terminals are securely coming contact with each other, thereby stabilizing the bonding condition.

Furthermore, in the first embodiment, in the case in which the first terminal and the second terminal are bonded together by electric resistance welding, the tip of the first terminal is not lifted toward the connector lead. Consequently, it is possible to prevent electric current from splitting as the result of the tip of the first terminal coming in contact with the connector lead. Specifically, this embodiment is effective in the case in which the length from the tip of the convex portion in the direction of the long side of the first terminal to the tip of the first terminal in the direction of its long side is greater than the height of the convex portion.

Furthermore, the first embodiment is a control device having a bus bar to which a lead is connected on a substrate. The bus bar is connected to a control module disposed on a substrate and is made up of an elongated metal plate on which a convex portion is created along the short side of the bus bar 12 from one end to the other end. The convex portion has a portion that does not extend in the direction of the short side. A lead is connected to another part other than the control module, and the bus bar is welded to the lead at the convex portion. Therefore, the convex portion is not deformed when the lead is strongly pressed onto the bus bar and welded together. For this reason, the area of the contact at which the bus bar comes in contact with the lead does not decrease, and a constant surface pressure can be ensured when the lead is strongly pressed onto the bus bar; therefore, secure and reliable connection can be ensured. Specifically, when the convex portion is bonded to the lead by electric resistance welding, it is possible to weld together the bus bar and the lead while they are securely coming contact with each other, thereby stabilizing the bonding condition.

Furthermore, a control device according to the first embodiment is disposed in an automobile's automatic transmission. Herein, when the control device is simply installed in an automobile, vibration is transmitted to the control device; and in the case in which the control device is installed in an automatic transmission, greater vibration is transmitted to the control device. For this reason, in case the bus bar and the lead are not strictly bonded together, they are apart from each other due to the vibration. Therefore, it is inspected whether the bus bar and the lead are securely bonded or not. Results of the inspection verified that defect can be significantly reduced by this embodiment wherein the convex portion has a portion that does not extend in the direction of the short side of the bus bar, when compared to a conventional technology wherein the convex portion is created along the direction of the short side of the bus bar.

Furthermore, in order to install a control device in an automatic transmission, the control device must be small. Therefore, it is possible to reduce the size of the area in which the bus bar is disposed by reducing the width of the bus bar specifically in the direction of its short side. Furthermore, when the width of the bus bar in the direction of its short side is reduced, the diameter of the lead to be used must be small as well. For this reason, the bus bar and the lead tend to be apart from each other due to vibration, and it is important to securely connect the bus bar to the lead from the aspect of manufacture. Herein, by using this embodiment, in the case in which a bus bar is made small so that it can be installed in an automatic transmission, it is possible to securely bond a lead with a small diameter to the bus bar.

Furthermore, in a first embodiment, a plurality of bus bars are disposed in a row on a substrate, and each lead is bonded to each of the bus bars; accordingly, it is possible to continuously bond together bus bars and leads. Depending on the shape of the electrodes, a plurality of bus bars can be bonded to leads simultaneously.

Furthermore, in the first embodiment, the lead is a connector lead which is connected to a connector that bonds to an external terminal. Therefore, to bond a lead to a bus bar, pressure must be applied during the bonding process.

As state above, the first embodiment has been described; therein, the convex portion 15 can be inclined on either side. However, in the case in which a plurality of bus bars 12 are disposed in a row and each of them is connected to each connector lead 13, it is recommended that the direction of tilt of each convex portion 15 be identical. Furthermore, an angle of tilt of the convex portion 15 can be set arbitrarily by considering the length of the bus bar 12 in the direction of its long side and the pressure to be applied.

Furthermore, in the same manner as a bus bar 12 in the first embodiment, the root portion of the bus bar 12 can be narrow in the direction of the short side of the bus bar 12 as long as the bus bar 12 extends longitudinally. Therefore, it is not necessary for the bus bar 12 to be a perfect rectangular plate.

Furthermore, even if the thickness of the bus bar 12 is between 0.2 mm and 1.2 mm and the length in the direction of the short side is not between 0.5 mm and 3 mm, effects of the first embodiment can be ensured. Moreover, it is preferable that the thickness of the bus bar 12 be between 0.4 mm and 0.8 mm, and the length in the direction of the short side be between 1 mm and 3 mm. Furthermore, even if the bus bar 12 and the connector lead 13 are not made of metal which contains copper, effects of the first embodiment can be ensured.

Furthermore, the second terminal does not have to be a wire such as a connector lead 13, and the second terminal can be a metal plate identical to the first terminal.

Furthermore, the connector lead 13 does not have to be bonded substantially along the direction of the long side of the bus bar 12, and the connector lead 13 can be connected diagonally or perpendicularly to the bus bar 12 so that the connector lead 13 intersects with the bus bar. Furthermore, the connector lead 13 does not have to be bonded at a substantially middle position in the direction of the short side of the bus bar 12, and the connector lead 13 can be bonded at a location on either one side.

Furthermore, in the first embodiment, the bus bar 12 and the connector lead 13 are bonded together by electric resistance welding. However, any application is possible in which bonding is executed while the bus bar 12 and the connector lead 13 securely come in contact with each other, and for example, adhesion by adhesives or brazing are applicable. Moreover, in the case in which electric resistance welding is not used, even if the length from the tip of the convex portion in the direction of the long side of the bus bar 12 to the tip of the bus bar 12 in the direction of its long side is greater than the height of the convex portion 15, electric current does not split. However, it is sufficiently effective that the area of the contact can be ensured at the time of bonding and constant surface pressure can also be ensured when pressure is applied.

Furthermore, in the first embodiment, the cross section of the convex portion 15 and the concave portion 16 is substantially trapezoidal; however, it does not have to be substantially trapezoidal, and for example, it can be substantially rectangular, substantially square, substantially triangular, substantially semicircular or of a combination of those shapes. Alternatively, to make the length of the entire convex portion 15 longer than the width of the bus bar, for example, the convex portion 15 can be T-shaped. Additionally, instead of creating a convex portion 15 along the entire width of the terminal, the convex portion 15 can be substantially linear with a portion unmolded.

Second Embodiment

Figure 5:
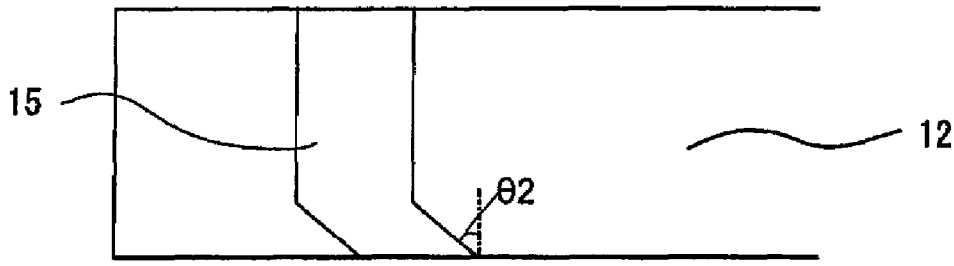
FIG. 5 is a top view of a first terminal according to a second embodiment.

Next, a second embodiment will be described with reference to FIG. 5. FIG. 5 is a top view of a first terminal according to the second embodiment. Hereafter, parts in common with the parts shown in a first embodiment are indicated by the same name and symbols.

As show in FIG. 5, in the second embodiment, a convex portion 15 is created along the direction of the short side of the bus bar 12, which functions as a first terminal, halfway up the direction of the short side of the bus bar 12, and the convex portion 15 has a portion having an angle to the direction of the short side on one end of the bus bar 12 in the direction of its short side. For this reason, the convex portion 15 is longer than the length of the bus bar 12 in the direction of the short side of the bus bar 12 and is bent; accordingly, the convex portion 15 has a portion that does not extend in the direction of the short side and a portion that intersects with the direction of the short side. Other portions are the same as those in the first embodiment.

Thus, the convex portion 15 in the second embodiment is bent; therefore, the convex portion 15 is not so easily crushed as that in the first embodiment. Furthermore, by connecting a connector lead 13 to a portion of the convex portion 15 created along the direction of the short side, when the connector lead 13 is bonded to the bus bar 12 with pressure, the connector lead 13 and the convex portion 15 become orthogonal. Therefore, it is possible, to the maximum extent, to prevent the connector lead 13 from removing from the convex portion 15.

Moreover, in the second embodiment, a portion of the convex portion 15 having an angle $\theta_2$ to the direction of the short side of the bus bar 12 can be created on either end of the convex portion in the direction of the short side of the bus bar 12, and the direction of tilt and the length can be arbitrarily set. Furthermore, it is also acceptable not to provide a portion of the convex portion 15 created along the direction of the short side of the bus bar 12, and for example, the convex portion 15 can be V-shaped.

Third Embodiment

Figure 6:
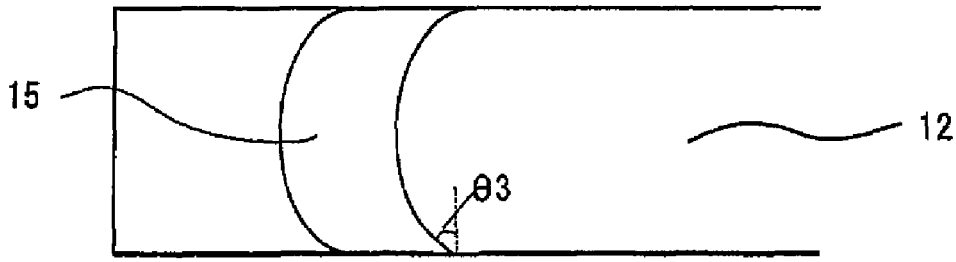
FIG. 6 is a top view of a first terminal according to a third embodiment.

Next, a third embodiment will be described with reference to FIG. 6. FIG. 6 is a top view of a first terminal in the third embodiment. Hereafter, parts in common with the parts shown in other embodiments are indicated by the same name and symbols.

As shown in FIG. 6, a convex portion 15 in the third embodiment is circular so that the convex portion 15 is convex toward the tip of the bus bar 12 which functions as a first terminal. For this reason, the convex portion 15 is longer than the length of the bus bar 12 in the direction of the short side and has a portion that does not extend in the direction of the short side and a portion that intersects with the direction of the short side. Other portions are the same as those in the first embodiment including an $\theta_3$ to the direction of the short side.

Thus, the convex portion 15 in the third embodiment is circular and has no angular portion; therefore, it is possible to prevent stress from concentrating. Furthermore, it is possible to increase life of a mold used to create the convex portion 15 by press work.

Moreover, the circular convex portion 15 in the third embodiment can be provided so that it is concave toward the tip of the bus bar 12. The location can arbitrarily be selected according to the location of the connection at which a connector lead 13 is connected to a bus bar 12. Furthermore, the R of the circular convex portion 15 can be set arbitrarily and the composite R can be possible.

Fourth Embodiment

Figure 7:
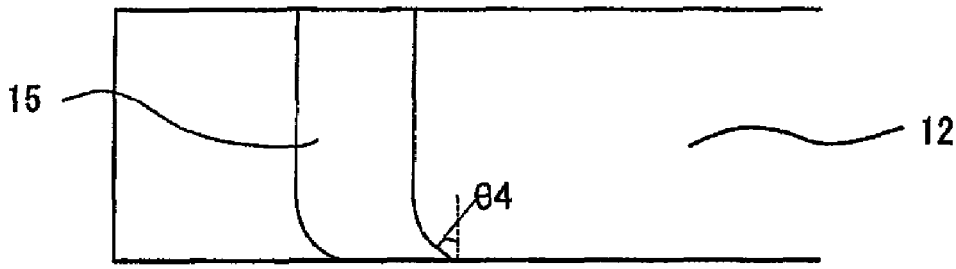
FIG. 7 is a top view of a first terminal according to a fourth embodiment.

Next, a fourth embodiment will be described with reference to FIG. 7. FIG. 7 is a top view of a first terminal in the fourth embodiment. Hereafter, parts in common with the parts shown in other embodiments are indicated by the same name and symbols.

As shown in FIG. 7, a convex portion 15 in the fourth embodiment is created along the direction of the short side of the bus bar 12, which functions as a first terminal, halfway up the direction of the short side of the bus bar 12, and one end portion of the concave portion 15 in the direction of the short side of the bus bar 12 is circular in the direction away from the tip of the bus bar 12 so as to define an angle $\theta_4$ to the direction of the short side. For this reason, the convex portion 15 is longer than the length of the bus bar 12 in the direction of its short side and has a portion that does not extend in the direction of the short side and a portion that intersects with the direction of the short side. Other portions are the same as those in the first embodiment.

Thus, in the same manner as a second embodiment, by connecting a connector lead 13 to the portion of the convex portion 15, in the fourth embodiment, created along the direction of the short side of the bus bar 12, it is possible, to a maximum extent, to prevent the connector lead 13 from removing from the convex portion 15. Furthermore, since one end portion of the convex portion 16 in the direction of the short side of the bus bar 12 is circular in the direction away from the tip of the bus bar 12, it is possible to prevent stress from concentrating in the same manner as a third embodiment, thereby making it possible to increase life of a mold. That is, the fourth embodiment can ensure the effects of both the second embodiment and the third embodiment.

Moreover, a circular portion of the convex portion on the bus bar 12 in the fourth embodiment can be created on either one end of the concave portion 15 in the direction of the short side of the bus bar 12, and the direction of tilt and the length can be set arbitrarily.

What is claimed is:

1. A terminal connection structure in which a second terminal is connected to a longitudinally extending first terminal with a short side, comprising:

a convex portion is provided on at one surface the first terminal from one end thereof to the other end thereof in a direction of the short side of the first terminal, and a concave portion which corresponds to the convex portion is created on an opposite surface of the convex portion;

both the convex portion and the concave portion are longer than the short side of the first terminal; and the second terminal is connected to the first terminal at the convex portion.

2. The connection structure of terminals according to claim 1 wherein the convex portion and the second terminal are connected by welding.

3. The connection structure of terminals according to claim 1 wherein both the convex portion and the concave portion have a portion having an angle to the direction of the short side of the first terminal.

4. The connection structure of terminals according to claim 3 wherein both the convex portion and the concave portion are substantially straight.

5. The connection structure of terminals according to claim 1 wherein both the convex portion and the concave portion are bent.

6. The connection structure of terminals according to claim 1 wherein both the convex portion and the concave portion have a circular portion toward the direction of the short side.

7. The connection structure of terminals according to claim 1 wherein the thickness of the first terminal is between 0.2 mm and 1.2 mm.

8. The connection structure of terminals according to claim 7 wherein the length of the first terminal in the direction of the short side is between 0.5 mm and 3 mm.

9. The connection structure of terminals according to claim 1 wherein both the first terminal and the second terminal are made of metal containing copper.

10. The connection structure of terminals according to claim 1 wherein the second terminal is a wire.

11. The connection structure of terminals according to claim 10 wherein the second terminal is bonded to the first terminal substantially along the direction of the long side of the first terminal.

12. The connection structure of terminals according to claim 11 wherein the second terminal is bonded in a substantially middle position of the first terminal in the direction of the short side of the first terminal.

* * * * *